United States Patent [19]

Peters

[11] Patent Number: 4,496,366

[45] Date of Patent: Jan. 29, 1985

[54] CONFIGURED FUEL BRIQUET AND METHOD

[75] Inventor: Susan M. Peters, Livermore, Calif.

[73] Assignee: The Clorox Company, Oakland, Calif.

[21] Appl. No.: 440,688

[22] Filed: Nov. 10, 1982

[51] Int. Cl.[3] ..... C10L 5/36

[52] U.S. Cl. ..... 44/14

[58] Field of Search ..... 44/14

[56] References Cited

U.S. PATENT DOCUMENTS 1,258,849 3/1918 Zwoyer et al. ..... 44/14

FOREIGN PATENT DOCUMENTS 392015 5/1933 United Kingdom ..... 44/14

*Primary Examiner*—Carl F. Dees

*Attorney, Agent, or Firm*—Stephen M. Westbrook; Joel J. Hayashida

[57] ABSTRACT

A charcoal briquet of any selected shape is configured to provide a preselected ignition time and total burning time response. A method of constructing such a briquet for any desired combustion response includes empirically deriving expressions for ignition time as a function of briquet volume, surface area and density, and for burn time as a function of volume and density, and configuring any selected shape briquet in accordance with the parameters found to provide such selected performance.

13 Claims, 10 Drawing Figures

FIGURE 8
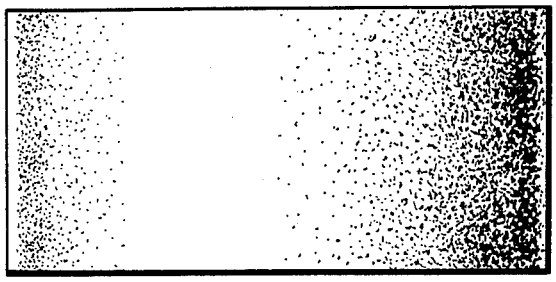
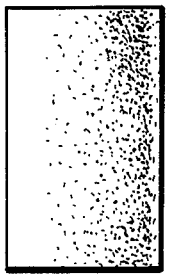
FIGURE 9
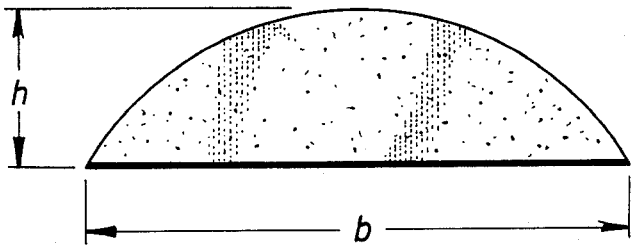
FIGURE 10

CONFIGURED FUEL BRIQUET AND METHOD

BACKGROUND OF THE INVENTION

This invention relates to the field of charcoal briquets and other solid fuel compositions in briquets or other geometric configurations, and more particularly to the design of dimensional and geometric specifications and configurations to achieve desired lighting and burn characteristics with respect to intended uses such as barbecue cooking. The most common example of such fuel compositions are charcoal briquets which comprise comminuted char of various vegetable materials, such as wood, hulls, pits, and other agricultural waste material which is mixed with a binder and rolled, pressed or otherwise formed into briquets. However the present invention has application to other solid fuel composition, such as comminuted wood or organic material, rolled, pressed or extruded into pellets, discs, briquets or other shapes.

Charcoal briquets presently available are typically provided in a "pillow" shape which provides for reasonably satisfactory ease of manufacturing by the supplier and handling by the consumer. However, little attention has been paid to their burning characteristics as related to their shape. As is well known, such briquets are typically used for cooking on a grill or the like by preparing a multiplicity of briquets in a mounded configuration, igniting their surface by some auxilliary ignition means such as lighter fluid, electric heaters, etc., and waiting until ignition of a significant portion of the briquets has progressed until a majority of the exposed surface is ignited, and burning has progressed inwardly toward the interior of the briquet. As burning proceeds inwardly from the surface of the briquet a gray ash is formed thereon. Thus completion of the initial "ignition phase" of burning is identifiable by the formation of such visual ash on the briquet, and is defined herein as the time at which there is 60–75% visual ash formation on the briquets.

Thereafter the briquets are typically spread under a grill or the like for cooking, and they continue to burn with an intense heat throughout a "burn phase". For maximum performance of such briquets it is desirable that the ignition phase be limited in time so that the briquets may be used for cooking without undue delay, and that the burn phase be extended to provide adequate cooking time for the use intended. It is further desirable to obtain such desirable combustion performance in the most efficient manner with respect to the amount of fuel consumed. There have been very little prior art developments related to design of solid fuel articles for desired combustion performance. There has been some work at ornamental configuration of fuel briquets, as well as geometrical configuration of briquets to enhance ignition or burning by enhancing air supply, such as provision of external surface discontinuities such as ribs, flutes, groups, slots or the like, and internal openings and passages of various configurations. Such attempts may enhance commencement of ignition or overall combustion, but do not provide desired optimal ignition and burning characteristics.

Other fuel briquets intended for very rapid ignition and delivery of intense heat provided a combination of powdered metal and oxidizers in a charcoal briquet having a higher ratio of surface area to volume and/or weight. However very rapid delivery of intense heat does not provide an acceptable combustion response for cooking purposes, and such prior art suggestions have made no attempt to quantify or optimize such ratios.

Other prior art briquets have recognized that the surface area to volume ratio of the briquet may affect ignition and burn characteristics and should be increased to provide rapid ignition and burning. However, such ratios have not been employed to design a briquet providing optimal desired ignition and burning characteristics.

Accordingly, it is an object of the present invention to provide a briquet which provides desired ignition and burn phase characteristics including a maximum ignition phase of 20 minutes, followed by a sustained burn phase.

A further object of this invention to provide such a briquet with desired ignition and burn phase characteristics regardless of specific composition, raw materials, geometric shape, size, or other manufacturing parameters which may be affected by supplies and economic considerations in the supply market.

SUMMARY OF THE INVENTION

The present invention provides a solid fuel briquet such as a charcoal briquet for cooking, which displays selected ignition and burn characteristics over a variety of shapes and compositions; and a method of forming such a briquet. A briquet for any selected shape is given the required dimensions to provide a weight to surface area ratio which has been empirically derived from experimental burns of briquets having a similar composition to provide a desired ignition response to complete the ignition phase in a preselected time, such as 20 minutes.

The burn phase of the briquet is designed by choosing a weight correlated to the half life of the briquet through an empirically derived formula. The density of the briquet is then chosen to provide such weight and geometric specifications. Thus the present invention provides a briquet which provides a 20 minute ignition period and a desired burn phase, with respect to any desired briquet shape.

BRIEF DESCRIPTION OF THE DRAWINGS

In the drawings:

FIG. 8 is a plan view of a "D"-shaped briquet embodying the present invention, FIG. 9 is an end view of the briquet of FIG. 8, and FIG. 10 is a side view of the briquet of FIG. 8.

DESCRIPTION OF THE PREFERRED EMBODIMENT

Figure 1:
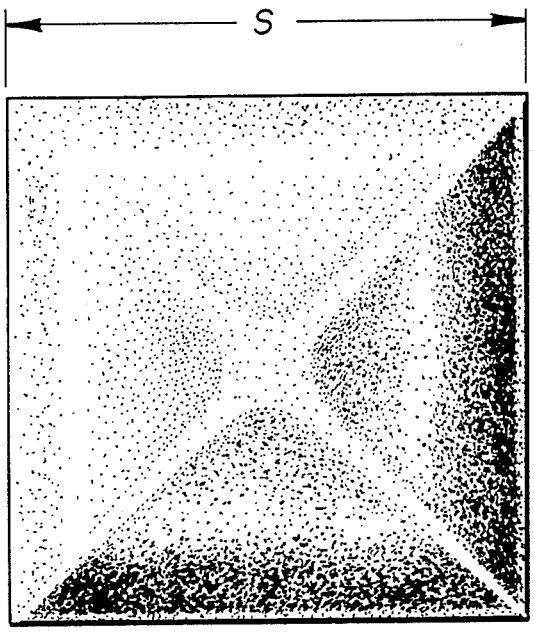
FIG. 1 is a plan view of a pillow briquet embodying the present invention.
Figure 2:
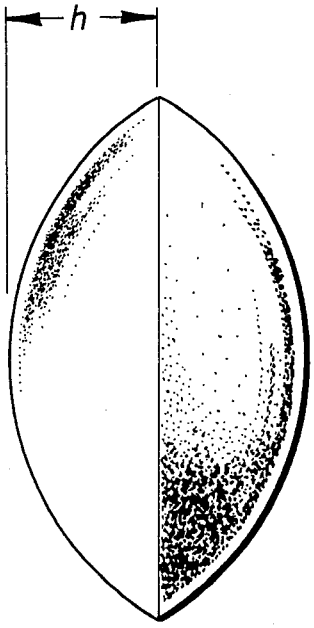
FIG. 2 is an end view of the briquet of FIG. 1.
Figure 3:
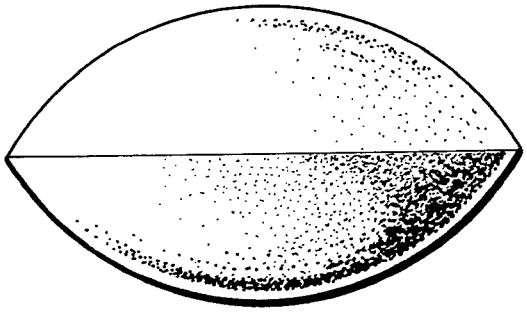
FIG. 3 is a side view of the briquet of FIG. 1.
Figure 7:
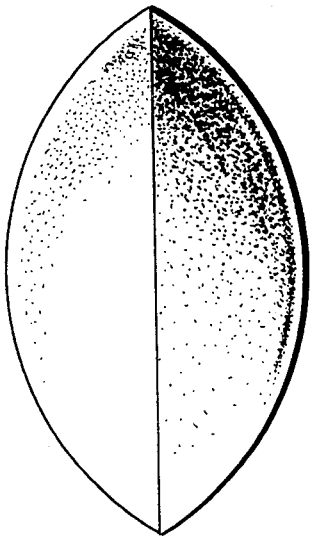
FIG. 7 is an end view of the briquet of FIG. 4.
Figure 6:
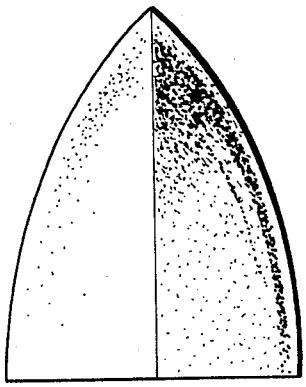
FIG. 6 is a view of the briquet of FIG. 4 taken along the line and in the direction indicated by the arrows 7—7 in FIG. 4.
Figure 4:
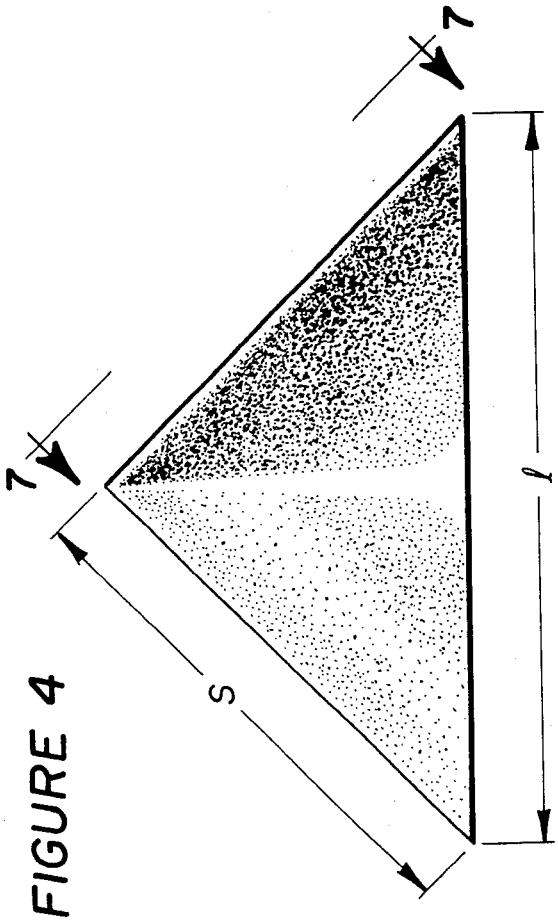
FIG. 4 is a plan view of a half-pillow briquet embodying the present invention.
Figure 5:
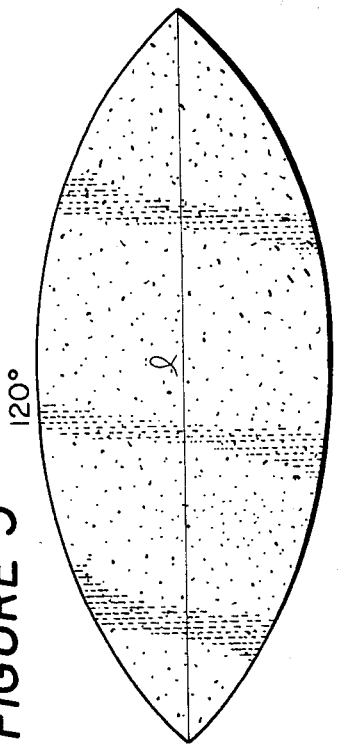
FIG. 5 is a side view of the briquet of FIG. 4.

FIGS. 1–3 are drawings of a "pillow" shaped briquet of charcoal or the like which embodies the present invention. Present and prior charcoal briquets have typically assumed such a general "pillow" configuration, but they have not been designed or provided in a configuration which provides a desired combustion performance. FIGS. 4–7 and 8–10 show a half-pillow briquet and a "D"-shaped briquet, respectively, embodying the present invention. Briquets of such configurations may be constructed with any desired dimensional relationships without departing from the present invention. However, in the preferred embodiments disclosed herein, the pillow and half-pillow have a side, S, equal to 3.5 times the height, h. The preferred D briquet has a base, b, equal to two times the depth. The total arc of the half-pillow briquet is 120°. Therefore the radius $=\frac{1}{2}\sqrt{2s^2}/\sin 60°$ and $l=\sqrt{2s^2}$. In the D-shaped briquets, the radius of the arc, $\gamma=2h=(b/2 \sin 60°)$.

Charcoal briquets and the like are employed by leaving a multiplicity of briquets initially mounded into a pile for better ignition. The combustion of such briquets is resolvable into an initial "ignition" phase which begins with the commencement of ignition and proceeds until the briquets are ignited over substantially their entire surface and combustion is proceeding inwardly of the briquet. At this time there is a significant rise in the temperature and heat generated by the burning briquets. This transition to the burning phase can be identified by a layer of gray ash which forms on the surface of the briquet after initial burning at the surface. For purposes of illustrating the present invention, the end of the ignition phase will be defined as the time at which 75% of the surface of the briquets display such a visual ash. Furthermore, for the preferred embodiment it is desired that such 75% visual ash occurs 20 minutes after commencement of ignition of the charcoal briquets. However it is to be understood that the present invention can be employed to design charcoal briquets with other ignition performance if desired.

Upon completion of ignition the briquets are normally spread out of a planar surface beneath the grill or the like where they continue to burn with an intense heat for a period of time during which they are employed for cooking or the like. This comprises a burn phase which is defined for the purposes hereof as the time from commencement of the ignition phase until the briquets have lost one-half of their weight. It is desired for the preferred embodiment that such burn phase comprise a minimum of 60 minutes. However again it is to be understood that the present invention may be employed to provide briquets with any other desired burn phase characteristics. The present invention provides a briquet having such a desired 20 minute ignition phase and a 60 minute burn phase regardless of the composition or configuration by designing the briquet dimensions and density to provide such a combustion response.

FORMULATION RANGES STUDIED

To provide such a briquet, a number of briquets were prepared having the following formulations:

| RAW MATERIAL | WEIGHT PERCENT RANGE (Dry Basis) Formula #1 | Formula #2 | Formula #3 |
|---|---|---|---|
| Retort Chars | 22.8 | 44.2 | 34.4 |
| Kiln Chars | 0 | 11.3 | 11.3 |
| Lignite Char | 35 | 0 | 13.9 |
| Mineral Carbons | 25.0 | 30 | 25.8 |
| Ignition Aid | 4.0 | 1.8 | 1.8 |
| Oxidizer | 3.0 | 1.5 | 1.8 |
| Density Modifier | 5.0 | 6.5 | 6.5 |
| Binders | 5.2 | 4.7 | 4.8 |

Shaped briquets, as shown in Table I, were prepared from the foregoing compositions. However, it is believed that any briquet within the above indicated ranges is effective for the purpose of this invention:

| RAW MATERIAL | WEIGHT PERCENT RANGE (Dry Basis) |
|---|---|
| Retort Chars | 22.8–44.2 |
| Kiln Chars | 0–11.3 |
| Lignite Char | 0–35 |
| Mineral Carbons | 25.0–30.0 |
| Ignition Aid | 1.8–4.0 |
| Oxidizer | 1.5–3.0 |
| Density Modifier | 5.0–6.5 |
| Binders | 4.7–5.2 |

Ten pounds of each briquet number were prepared in the configuration, dimensions and density shown. A two pound pile of each shape and size briquet was prepared and ignited and the percent of visual ash on the surface of the briquets was noted at 20 minutes after commencement of ignition. Three such burns of each briquet were made in a random order. Table I indicates the results of such tests.

TABLE 1

| Briquet No. | Briquet Shape | % Visual Ash (20 Min) | Half Life (Min) | Volume ($cm^3$) | Surface Area ($cm^2$) | Density ($g/cm^3$) | $\frac{V.d}{A}$ ($g/cm^2$) | V.d (g) | Formulation No. |
|---|---|---|---|---|---|---|---|---|---|
| 1. | Cube | 92.5 | 54.4 | 20.48 | 45.16 | 0.82 | 0.372 | 16.8 | 1 |
| 2. | Triangular Prism | 87.5 | 56.6 | 21.08 | 50.14 | 0.88 | 0.370 | 18.6 | 1 |
| 3. | Sphere | 82.5 | 50.0 | 32.76 | 49.51 | 0.65 | 0.430 | 21.3 | 1 |
| 4. | Cylinder | 81.0 | 91.0 | 10.05 | 28.5 | 1.22 | 0.430 | 12.3 | 3 |
| 5. | Rectangular Prism | 71.5 | 58.2 | 30.73 | 61.29 | 0.79 | 0.396 | 24.3 | 1 |
| 6. | "Octahedron" | 68.5 | 51.0 | 19.46 | 52.42 | 1.17 | 0.434 | 22.8 | 1 |
| 7. | Cube | 67.0 | 87.0 | 35.21 | 64.52 | 0.95 | 0.518 | 33.4 | 2 |
| 8. | Triangular Prism | 66.0 | 90.0 | 24.85 | 54.24 | 1.087 | 0.498 | 27.0 | 2 |
| 9. | Cylinder | 43.0 | 97.3 | 30.42 | 54.0 | 1.04 | 0.586 | 31.6 | 2 |
| 10. | Cylinder | 41.0 | 95.0 | 25.13 | 47.5 | 1.09 | 0.577 | 27.4 | 3 |
| 11. | Pillow | 28.5 | 75.1 | 30.0 | 49.7 | 0.89 | 0.536 | 26.7 | 1 |
| 12. | Cylinder | 20.4 | 145 | 40.22 | 66.5 | 1.04 | 0.629 | 41.8 | 3 |
| 13. | Pillow | 17.0 | 107 | 40.0 | 45.2 | 0.86 | 0.760 | 34.4 | 2 |
| 14. | Cylinder | 15.6 | 170 | 50.27 | 79.18 | 1.13 | 0.717 | 56.8 | 3 |

In considering ignition performance, it was assumed that since visual ash is a surface phenomenon it should be a function of surface area.

It was also assumed that the amount of fuel contained in the surface area layer will be a function of the total amount of fuel contained in a briquet. Thus visual ash formation will be a function of the weight of the briquet, and inversely related to the area of the briquet. Therefore, for each shape of briquet, the ratio of briquet weight to surface area was compared with respect to performance during the ignition phase. The data in Table I was therefore examined with respect to the ratio of weight to surface area, or volume and density to surface area.

An equation for the time for formation of visual ash in 20 minutes, empirically derived from the data by linear regression, was found to be:

$$\%\ \text{Visual Ash}_{(20\ min)} = -207(V/A \times D) + 163$$

Solving this equation for the desired 75% visual ash in 20 minutes, the quantity $V/A \times D$ will equal 0.426 g/cm$^2$. With a typical density of 0.9 g/cm$^3$, the volume/area ratio would therefore be 0.473 cm. Therefore, to provide a briquet which provides 75% visual ash in 20 minutes for any shape, the dimensions with respect to any desired shape are chosen to provide this volume/area ratio. Examples of such dimensions for representative shapes are shown in Table II.

TABLE II

| Shape | Volume/Area Ratio | Characteristic Dimension for 75% Visual Ash in 20 Min |
|---|---|---|
| Pillow | $\frac{h(S^2 + 1.05h^2)}{2.42\ S^2}$ | (with S = 3.5h); h = 1.05 cm S = 3.68 cm |
| Half-Pillow | $\frac{0.216\ h(S^2 + 1.05h^2)}{S^2}$ | (with S = 3.5h); h = 2.0 cm S = 7.0 cm |
| "D" | $\frac{b}{14.90}$ | (with b = 2 Depth); b = 7.04 cm Depth = 3.52 cm |
| Cube | | S/6 S = 2.84 cm |
| Sphere | | R/3 R = 1.42 cm |
| Tetrahedron | | S/14.7 S = 6.95 cm |
| Octahedron | | S/7.3 S = 3.45 cm |
| Right Cylinder | $\frac{RH}{2\ (R + H)}$ | with R = ½ H; R = 1.42 cm; H = 2.84 cm |
| Equilateral Triangular Prism | $\frac{SH}{3/2\ S + H}$ | with S = ½ H; S = 1.98 cm; H = 3.78 cm |

Considering burn time, it is desirable to provide a briquet with maximum burn time per unit of fuel for maximum efficiency. The fuel briquet typically burns with a sustained reasonably constant temperature and thermal output of a very significant portion of its life, and then tails off as total consumption is approached. Therefore effective life of a fuel briquet has been considered its half-life for the purposes of this development, said half-life being defined as the amount of time from initial ignition until the fuel briquet loses one-half of its weight. It was further considered that an adequate cooking time for a charcoal briquet or the like would require a half-life of 60 to 90 minutes.

Table I shows the results of burn experiments for various shapes with respect to this half-life. A formula for the briquet half-life, derived by linear regression, was found to be:

$$T_{0.5}\ (\text{min}) = 3.3(V.d) - 9.8.$$

Thus, for the range of fuel composition given hereinabove, a briquet with a half-life of 60, 75 or 90 minutes should have a mass of 21 g, 26 g or 30 g respectively.

To design a briquet to give the desired ignition phase and burn phase responses, the visual ash equation and half-life equation may be combined for any given briquet shape.

EXAMPLE I

To design a briquet in the shape of a cube with a 20 minute ignition phase (for 75% visual ash) and a 75 minute burn phase, the burn phase formula is employed to find the required volume times the density quantity as follows:

$$75\ \text{min.} = 3.3(V{\cdot}d) - 9.8$$

$$V{\cdot}d = 25.7\ \text{g}$$

Employing this volume times density quantity in the ignition phase formula:

$$75\%\ \text{visual ash} = -207(25.7/A) + 163$$

or $$A = 60.45\ \text{cm}^2$$

From Table II for a cube:

$$A = 6\ S^2$$

$$S = 3.174\ \text{cm}$$

$$\text{Cube} = S^3 = 31.98\ \text{cm}^3$$

Now solving for density in the burn phase equation:

$$25.7\ \text{g} = V{\cdot}d = 31.98\ \text{cm}^3{\cdot}d$$

$$\text{or density} = 0.8\ \text{g/cm}^3$$

Thus for a cube briquet which will produce a 75% visual ash in 20 minutes and a 75 minute half-life, a briquet with a side of 3.174 cm and a density of 0.8 g/cm$^3$ is required.

Similarly, other briquet shapes can be designed to provide desired ignition and burn phase performance.

EXAMPLES II–IV

Briquets of pillow, diagonal half-pillow and "D" configurations as shown in FIGS. 1 through 3 were prepared in accordance with this invention. Equipment limitations required a constant density of approximately 0.95 g/cm$^3$. However, improvement of ignition phase characteristics of a particular shape was considered of primary interest, and examining burn duration as a secondary characteristic.

Setting required 20 minute visual ash at 75% and density at 0.95 g/cm$^3$:

$$75\% = -207\left(\frac{V.95}{A}\right) + 163$$

$$V/A = 0.4475\ \text{g/cm}^2$$

Thus the required volume to area ratio is 0.4475 g/cm$^2$.

Using the volume to area values outlined in Table II, the following are the necessary dimensions for the three shapes to achieve 75% visual ash:

| Pillow | Diagonal Cut Half-Pillow | "D" |
|---|---|---|
| h = 1.0 cm | h = 1.91 cm | b = 6.668 cm |
| S = 3.5 cm | S = 6.685 cm | Depth = 3.334 cm |

In fabricating dies for production of briquets to test, an attempt was made to come as close as possible to the specified dimensions. However, some changes were necessary, limited to ±5.5%.

Table III outlines the results of briquet burn tests on briquets made within the above limits to the prescribed dimensions. Table IV shows a relatively good fit of observed and predicted responses. Statistical analyses indicate the observed and predicted responses to be equivalent and within the experimental error of the burn evaluations methods.

TABLE III

| Briquet Shape | % Visual Ash 20 Min. Observed | Predicted | Half-Life (Min.) Observed | Predicted | Dimensions S(cm) | h(cm) | Volume (cm$^3$) | Surface Area (cm$^2$) | Density (g/cm$^3$) | V.d. / a. (g/cm$^2$) | V · d (g) |
|---|---|---|---|---|---|---|---|---|---|---|---|
| Pillow | 94 | 84.3 | 44.4 | 36 | 3.87 | 0.93 | 14.78 | 36.22 | 0.93 | 0.380 | 13.75 |
| Diagonal ½ Pillow | 97 | 100 | 46.6 | 26 | 4.0 | 1.35 | 12.09 | 37.05 | 0.90 | 0.294 | 10.88 |
| "D" | 95 | 97.4 | 43.9 | 30 | b = 5.02 | d = 2.51 | 12.79 | 37.96 | 0.94 | 0.317 | 12.02 |
| Pillow | 43 | 50.6 | 74 | 73 | 4.36 | 1.27 | 26.29 | 45.97 | 0.95 | 0.543 | 24.98 |
| Diagonal ½ Pillow | 90 | 91 | 67 | 57 | 5 | 1.6 | 22.14 | 57.89 | 0.91 | 0.348 | 20.15 |
| "D" | 80 | 75.9 | 82.1 | 81 | b = 6.6 | d = 3.3 | 29.06 | 65.61 | 0.95 | 0.421 | 27.61 |
| | $R^2$ = 0.99 | | $R^2$ = 0.95 | | | | | | | | |

If the limits of an acceptable briquet are defined as 70% or more visual ash in 20 minutes and a half-life of 60 to 100 minutes, then the limitations on acceptable briquet configurations will be:

| | |
|---|---|
| (For 60–100 minute half-life): | volume × density = 21 g to 33 g. |
| (For 70% or greater visual ash in 20 minutes): | volume/area × density ≦0.449 g/cm$^2$. |

Accordingly it will be appreciated that the present invention provides a means of providing a briquet of any desired shape with designed parameters to give desired ignition and burn phase responses for anticipated applications such as cooking. However it will be appreciated that the present invention is useful for designing similar briquets of other compositions and for other applications, and is not limited to the specific briquets disclosed herein.

What is claimed is:

1. A charcoal briquet having a geometry configured to produce a selected burn performance including a first ignition phase and a second, burn phase, said briquet being configured to provide an ignition phase defined as a selected percent of visual ash on the outer surface of the briquet formed in a preselected time.

2. The charcoal briquet of claim 1 in which said ignition phase is selected as 20 minutes and the briquet is configured in accordance with the equation:

$$\text{Desired Percent Visual Ash} = -207(V \cdot d/A + 163).$$

3. The charcoal briquet of claim 2 further having a preselected half-life, and configured in accordance with the equation:

$$T_{0.05} = 3.3\ (V \cdot d) - 9.8.$$

4. The invention of claim 2 wherein said charcoal briquet has a ratio of $V \cdot d/A \leqq 0.45$.

5. The briquet of claim 4, wherein the product of its volume and density is equal to or greater than 21.

6. A method of constructing a fuel briquet to provide desired ignition time comprising empirically deriving an ignition time formula for said desired ignition time as a function of briquet volume to area times density by linear regression, and choosing briquet dimensions for a selected briquet shape which provides said volume to area ratio for a selected briquet density.

7. The method of claim 6 further comprising a method of constructing said briquet to provide desired burn time characteristics, said method comprising empirically deriving a burn time formula by linear regression for briquet half-life as a function of its weight, employing said weight in the ignition time formula to define the briquet area, providing a selected shape of briquet with the dimensions required for said area and the density required for the required volume.

8. A method of constructing a briquet that has an ignition phase of 20 minutes comprising selecting a briquet shape, dimension and density so that $(V/A) \cdot d \leqq 0.449$ g/cm$^2$.

9. The invention of claim 8 further comprising a method of insuring a 60 to 100 minute half-life by selecting the briquet volume and density so that $V \cdot d = 21$ to 33 g.

10. A pillow shaped charcoal briquet having a height substantially equal to 1.0 cm and a side substantially equal to 3.5 cm.

11. A diagonal cut half pillow charcoal briquet having a height substantially equal to 1.91 cm and a side substantially equal to 6.685cm.

12. A D-shaped charcoal briquet having a base substantially equal to 6.668 cm and a depth substantially equal to 3.334 cm.

13. The charcoal briquet of claim 1, wherein said ignition phase comprises approximately 75% of visual ash on the outer surface of the briquet formed in a preselected time.

* * * * *